United States Patent [19]

Ward et al.

[11] 4,351,857

[45] Sep. 28, 1982

[54] NEW SURFACE IN CELLULOSIC FIBERS BY USE OF RADIOFREQUENCY PLASMA OF AMMONIA

[75] Inventors: Truman L. Ward; Ruth R. Benerito, both of New Orleans, La.

[73] Assignee: The United States of America as represented by the Secretary of Agriculture, Washington, D.C.

[21] Appl. No.: 294,095

[22] Filed: Aug. 19, 1981

[51] Int. Cl.[3] ..... B05D 3/06

[52] U.S. Cl. ..... 427/40; 8/125; 8/444; 8/DIG. 12; 427/41; 427/399

[58] Field of Search ..... 8/444, DIG. 12, 125; 427/40, 41; 427/399, 393.2, 393.4

[56] References Cited

U.S. PATENT DOCUMENTS

| | | | |
|---|---|---|---|
| 2,932,591 | 6/1956 | Goodman | 427/81 |
| 2,977,475 | 3/1961 | Kassenbeck | 8/444 |
| 3,600,122 | 8/1971 | Coleman | 427/40 |
| 3,944,709 | 3/1976 | Levy | 427/40 |

OTHER PUBLICATIONS

Goodman, J., The Formation of Thin Polymer Films in the Gas Discharge, J. Polym. Sci. 44, 551–552, (1960).

Jung, H. Z., Ward, T. L., and Benerito, R. R., Effects of Cold Plasma on Water Absorption of Cotton, Textile Res. J. 47, 217, 222, (1977).

Pavlath, A. E. and Slater, R. F., Low Temperature Plasma Chemistry I, Shrinkproofing of Wool, App., Polym. Symp. 18, 1317–1342, (1971).

Riccobono, P. X., et al., Plasma Treatment of Textiles; A Novel Approach to the Environmental Problems of Desizing, Textile Chem. Color 5 (11), 239–248, (1973).

Stone, R. B., Jr., and Barrett, J. R., Jr. U.S.D.A. Study Reveals Interesting Effects of Gas Plasma Radiations on Cotton Yarn, Textile Bull. 88, 65–68, (1962).

Ward, T. L., Jung, H. Z. Hinojosa, O., and Benerito, R. R., Characteristics and Use of R. F. Plasma-Activated Natural Polymers, APPL. POLYMER SCI. 23, 1987–2003, (1979).

Ward T. L., Jung., H. Z. Hinojosa O., and Benerito R. R., Effect of RF Cold Plasmas on Polysaccharides, J. Surface Sci. 76, 257–273 (1978).

*Primary Examiner*—John D. Smith

*Attorney, Agent, or Firm*—M. Howard Silverstein; David G. McConnell; Raymond C. Von Bodungen

[57] ABSTRACT

A process for producing a polymeric-type film in the surface of cellulosic fibers is disclosed. Cellulosic fibers are irradiated in the colored area of a radiofrequency plasma of ammonia for a period of about 10 minutes to 2 hours in a reactor designed to admit ammonia between electrodes at a rate such that all of the ammonia molecules have been activated to plasma. A polymer coating is formed in the surface of the cellulosic fibers that is alkali resistant, water-repellent and improves the wrinkle recovery of the fabrics.

7 Claims, No Drawings

NEW SURFACE IN CELLULOSIC FIBERS BY USE OF RADIOFREQUENCY PLASMA OF AMMONIA

BACKGROUND OF THE INVENTION (1) Field of the Invention

This invention relates to a process for producing a polymeric-type film or coating in the surface of cellulosic fiber.

(2) Description of the Prior Art

The use of radiofrequency generated plasmas to alter properties of fabrics, yarns, and fibers is known in prior art. However, no mention of the formation of polymeric material in the fiber surface by use of radio-frequency generated ammonia plasma has been found.

Low-temperature, low pressure plasmas are especially suited for modification of natural polymers, Jung, H. Z., Ward, T. L., and Benerito, R. R., Effect of Cold Plasma on Water Absorption Cotton. Textile Res. J. 47, 217–222 (1977); Pavlath, A. E. and Slater, R. F., Low Temperature Plasma Chemistry I. Shrinkproofing of Wool, Appl. Polym. Symp. 18, 1317–1324 (1971); Riccobono, P. X., et al., Plasma Treatment of Textiles; A Novel Approach to the Environmental Problems of Desizing, Textile Chem. Color 5 (11), 239–248 (1973); Stone, R. B., Jr. and Barrett, J. R., Jr. U.S.D.A. Study Reveals Interesting Effects of Gas Plasma Radiations on Cotton Yarn, Textile Bull. 88, 65–68 (1962); Ward, T. L., Jung, H. Z., Hinojosa, O., and Benerito, R. R., Effect of RF Cold Plasmas on Polysaccharides, J. Surface Sci. 76, 257–273 (1978).

These "cold" plasmas are generated by gaseous electric discharge, provide a source of high-energy electrons without excessive heating, and are highly reactive chemically. Free electrons receive energy from the radiofrequency (rf) electric field and through collision with neutral gas molecules, generate new chemically-active species of atoms, ions, and free radicals. In contrast to thermally-induced reactions, where energy is usually equally distributed among all particles in the system, energy in plasma reactions is supplied principally to the free electrons. Electron temperatures may reach $10^4$K, but surroundings remain near ambient. Since plasma particles penetrate only to about 100 mm, the technique can affect the surface of polymeric materials without altering their bulk properties.

In 1960 Goodman, J., Dielectric Coated Electrodes, U.S. Pat. No. 2,932,591 (April 1960); Goodman, J., The Formation of Thin Polymer Films in the Gas Discharge, J. Polym. Sci. 44, 551–552 (1960), deposited extremely uniform and pinhole-free polymer films on glass and other nonconducting substrates by polymerization of monomer vapor in a gaseous electric discharge. In 1962 Stone and Barrett, Stone, R. B., Jr., and Barrett, J. R., Jr., U.S.D.A. Study Reveals Interesting Effects of Gas Plasma Radiations on Cotton Yarn, Textile Bull. 88, 65–68 (1962), showed that glow-discharge treatment of cotton yarn increased its water absorbency and strength. More recently (1971) Coleman grafted acrylic acid to polymeric substrates, Coleman, J. H., Method of Grafting Ethylenically Unsaturated Monomer to a Polymeric Substrate, U.S. Pat. No. 3,600,122 August 1971), on which were created free-radical sites by moving the substrate through a spark discharge in a zone of initiator gas. Pavlath and Slater, Pavlath, A. E. and Slater, R. F., Low Temperature Plasma Chemistry I. Shrinkproofing of Wool, Appl. Polym. Symp. 18, 1317–1324 (1971), found that exposure of wool to low-temperature plasmas increased strength and abrasion resistance while reducing felting shrinkage. We have previously reported, Jung, H. Z., Ward, T. L., and Benerito, R. R., Effect of Cold Plasma on Water Absorption of Cotton. Textile Res. J. 47, 217–222 (1977); Ward, T. L., Jung, H. Z., Hinojosa, O., and Benerito, R. R., Characteristics and Use of R. F. Plasma-Activated Natural Polymers, Appl. Polym. Sci. 23, 1987–2003 (1979); Ward, T. L., Jung, H. Z., Hinojosa, O., and Benerito, R. R., Effect of RF Cold Plasmas on Polysaccharides, J. Surface Sci. 76, 257–273 (1978), studies of the effect of rf plasmas of argon, nitrogen or air on a group of polysaccharides that included cotton and purified cellulose.

SUMMARY OF THE INVENTION

This invention relates to a process for producing a polymeric-type film in the surface of cellulosic fibers. More particularly, this invention relates to a process for producing a surface that is alkali-resistant, water-repellent and that improves the conditioned wrinkle-recovery of the fabrics made of cellulosic fibers.

The production of polymeric material in the surface of the fiber by ammonia plasma would not be expected on the basis of the action of other plasmas which may produce a thin coating on the surface. The production of polymeric material in the surface of the fiber would not be expected on the basis of the action of either liquid or gaseous ammonia on cellulosic fibers which may cause a change in crystalline lattice structure, but does not react either with or on the cellulose if only the cellulose and ammonia are present. Plasmas of nitrogen gas result in increased hydrophilcity so the improved water repellency would not be expected by extropolation from experience using nitrogen plasma. Furthermore, a polymeric material formed in the surface of a cellulosic fiber by a plasma would not necessarily result in improved resistance to wrinkling, water and base.

In general, in accordance with the present invention, material containing cellulosic fibers is treated by irradiation in the plasma created by exposure of ammonia gas at reduced pressure to a radiofrequency electric field. In carrying out the process of the invention the cellulosic material is irradiated in the colored ammonia plasma area. The length of irradiation will vary with the power level and can be increased to produce additional polymer in the surface.

Substantially any fabric, sheet, yarn, or thread that is constructed of fibers that are essentially cellulose can suitably be employed in the instant invention.

An essential part of the process of the instant invention is a constant supply of ammonia into the reactor through an inlet that causes the ammonia to be admitted to the reactor by passing through the radio frequency electric field.

Cellulosic fibers are exposed to a radio-frequency generated plasma of ammonia gas in the colored area of the radiofrequency plasma of ammonia in a reactor designed so that the ammonia is admitted into the reactor area between the electrodes and at such a rate that all of the ammonia molecules have been activated to plasma. Thus polymeric type film is produced in the surface of the cellulosic fiber.

A primary object of the instant invention is to improve the resistance of fabrics containing fibers to wrinkling. A further object is to provide a process for improving the water repellency of fabrics containing cellulose fibers. A further object is to provide a process for improving the resistance of cellulosic materials to dissolution in aqueous basic solutions such as cupriethylene diamine hydroxide (cuene) solution.

DESCRIPTION OF THE PREFERRED EMBODIMENTS

In general, in accordance with the present invention, material containing cellulosic fibers is treated by irradiation in the plasma created by exposure of ammonia gas at reduced pressure to a radiofrequency electric field. In carrying out the process of the invention the cellulosic material is irradiated in the colored ammonia plasma for at least 10 minutes. The length of irradiation will vary with the power level and can be increased to produce additional polymers in the surface.

Substantially any fabric, sheet, yarn, or thread that is constructed of fibers that are essentially cellulose can suitably be employed in the present process.

For generating the plasma, substantially any radiofrequency field from about 1 to 30 megahertz can suitably be employed and the power level required will depend on the pressure in the reaction vessel. Lower pressures require less power from the generator. An essential part of the process of the instant invention is a constant supply of ammonia into the reactor through an inlet that causes the ammonia to be admitted to the reactor by passing through the radiofrequency electric field. Substantially any level of ammonia flow can be used that will allow maintenance of the colored plasma and not allow untreated ammonia to be passed through the atmosphere via the vacuum pumps.

In carrying out the preferred process the cellulosic material is suspended on glass prongs in the plasma reaction vessel. A vacuum pump is used to reduce the pressure to 100–500 millitorr range. The radiofrequency generator operating at 13.56 megahertz is turned on and adjusted to a power level of between 20 and 80 watts of output power. Ammonia gas is bled into the reactor through an inlet between the electrodes at a rate of about one to five standard cubic centimeters per minute. The impedance matching network between the electrodes and the rf generator are adjusted for maximum plasma glow. The sample is irradiated for about 10 minutes to two hours with the longer time period required at the lower end of the power range. At the end of the alloted time period, the ammonia is turned off, the rf generator is stopped, the reactor pressure restored to atmospheric and the sample removed.

The following examples illustrate, but do not limit the scope of the invention.

EXAMPLE 1

1.5×4 cm retangular pieces of desized, scoured and peroxide bleached cotton printcloth were placed in 3 positions in a radiofrequency (rf) plasma reactor with samples laid in a flat, horizontal position on glass prongs so the plasma could reach virtually the entire surface of the samples. Sample position A was between the electrodes of the reactor, location B was just downstream from the electrodes going toward the outlet to the vacuum pumps and location C was further downstream than B. All of the samples were within the colored area of the plasma. The reactor was evacuated to 150 millitorrs and the rf generator was turned on and the output power adjusted to 40 watts at 13.56 megahertz. Ammonia was bled into the reactor through an inlet between the electrodes at the rate of 1 standard cubic centimeter per minute (SCCM) and the impedance network of variable conductance and capacitance was adjusted for maximum plasma glow. The samples were irradiated for 1 hour. Ammonia flow was shut off, the rf generator stopped, reactor returned to atmospheric pressure and the samples removed.

All three samples had newly formed material in the surface of the fibers. The material was not dissolved by soaking for 30 minutes in 0.5 molar aqueous cupriethylenediamine hydroxide solution. The fabrics showed a 25% gain in conditioned (dry) wrinkle recovery and the fabrics exhibited water repellency (the untreated control had no water repellency). Scanning electron microscopy of the surface and transmission electron microscopy of fiber cross sections showed that the new material was in the surface rather than on the surface of the fibers. Multiple internal reflectance infrared spectroscopy indicated carbonyl structure in the infrared region associated with an amide structure. An NH bonding was also shown by IR. No carbon to nitrogen multiple bonding was shown and this band is strong when the plasma contains nitrogen rather than ammonia. ESCA examination showed that the newly formed surface has an added nitrogen atom per anhydroglucose unit and about twenty percent more oxygen. The surface area resists layering by a test commonly used to detect polymerization. Polymers do not layer while untreated cellulose does layer.

EXAMPLE 2

The procedure of Example 1 except that rayon fabric was used in place of cotton. Results are same as Example 1.

EXAMPLE 3

The procedure of Example 1 except that filter paper made from wood pulp was used in place of cotton. Results were the same as Example 1.

EXAMPLE 4

The procedure of Example 1 except plasmas of nitrogen or of a mixture of one part $N_2$ gas to 3 parts $H_2$ gas were used in place of ammonia. No polymer was found in the fiber surfaces.

EXAMPLE 5

The procedure of Example 1 except the sample was located outside the colored plasma. Negligible polymer was formed in the fiber surfaces.

We claim:

1. A process for producing a polymeric-type film in the surface of cellulosic fibers which process comprises:

irradiating cellulosic fibers in the colored area of a radiofrequency plasma of ammonia in a reactor designed so that the ammonia is admitted into the reactor area between electrodes and at such a rate so that all of the ammonia molecules have been activated to plasma.

2. The process of claim 1 wherein the fibers are irradiated for a period of about 10 minutes to 2 hours.

3. The process of claim 1 wherein the radiofrequency field is from about 1 to 30 megahertz and the power level will depend on the pressure in the reaction vessel.

4. The process of claim 1 including reducing the pressure in the reactor vessel to the range of about 100 to 500 millitorr, the radiofrequency generator operates at 13.56 megahertz and adjusted to a power level of between 20 and 80 watts of output power, and the ammonia gas is bled into the reactor through an inlet between the electrodes at a rate of about one to five standard cubic centimeters per minute, the impedance matching network between the electrodes and the rf generator is adjusted for maximum plasma glow, the sample is irradiated for about 10 minutes to 2 hours with the longer time period required at the lower end of the power range, and at the end of the allotted time period, the ammonia is turned off, the rf generator is stopped, the reactor pressure restored to atmospheric and the sample removed.

5. The process of claim 1 wherein the cellulosic fiber is desized, scoured and peroxide bleached cotton-print-cloth.

6. The process of claim 1 wherein the cellulosic fiber is rayon fabric.

7. The process of claim 1 wherein the cellulosic fiber is filter paper made from wood pulp.

* * * * *